US005823075A

United States Patent [19]

Torrekens

[11] Patent Number: 5,823,075

[45] Date of Patent: Oct. 20, 1998

[54] TIGHTENING SPANNER

[76] Inventor: Daniel Octaaf Ghislain Torrekens, Rue de la Station 22, 7850 Enghien, Belgium

[21] Appl. No.: 633,822

[22] PCT Filed: Oct. 25, 1994

[86] PCT No.: PCT/BE94/00072

§ 371 Date: Jun. 28, 1996

§ 102(e) Date: Jun. 28, 1996

[87] PCT Pub. No.: WO95/11776

PCT Pub. Date: May 4, 1995

[30] Foreign Application Priority Data

Oct. 25, 1993 [BE] Belgium ..... 9301139

[51] Int. Cl.[6] ..... B25B 13/46

[52] U.S. Cl. ..... 81/57.39; 92/187; 92/256

[58] Field of Search ..... 81/57.39, 57.44; 92/179, 187, 256

[56] References Cited

U.S. PATENT DOCUMENTS

| | | | |
|---|---|---|---|
| 3,451,315 | 6/1969 | Rumsey | 92/187 X |
| 3,802,323 | 4/1974 | Suechting | 92/187 X |
| 4,201,099 | 5/1980 | Junkers . | |
| 4,480,510 | 11/1984 | Aparacio, Jr. et al. . | |
| 4,663,997 | 5/1987 | Junkers . | |
| 4,805,496 | 2/1989 | Wagner et al. . | |
| 4,854,197 | 8/1989 | Walton | 81/57.39 |
| 5,103,696 | 4/1992 | Beuke | 81/57.39 |
| 5,279,211 | 1/1994 | Bentz et al. | 92/256 X |
| 5,305,684 | 4/1994 | Melchior | 92/256 X |
| 5,435,234 | 7/1995 | Bentz et al. | 92/256 X |

FOREIGN PATENT DOCUMENTS

| | | |
|---|---|---|
| 0179543 | 4/1986 | European Pat. Off. . |
| 0276936 | 8/1988 | European Pat. Off. . |
| 2914707 | 10/1980 | Germany . |
| 3416881 | 11/1985 | Germany . |
| 3620753 | 9/1987 | Germany . |
| 3917828 | 12/1990 | Germany . |
| 2028204 | 3/1980 | United Kingdom . |

*Primary Examiner*—D. S. Meislin
*Attorney, Agent, or Firm*—Laff, Whitesel, Conte & Saret, Ltd.

[57] ABSTRACT

A hydraulically-powered tightening and loosening spanner includes a ratchet wheel assembly, a retaining mechanism, a drive lever connected to a piston rod and fixedly supporting a guide, and a member rotating the ratchet wheel assembly and including a slide which supports one or more drive elements and is slidable along the guide during reciprocal motion of the piston.

2 Claims, 4 Drawing Sheets

TIGHTENING SPANNER

This is a 371 of PCT/BE94/00072, filed Oct. 25, 1994.

The present invention relates to a hydraulically powered tightening and loosening spanner.

Described in U.S. Pat. No. 4,201,099 is a hydraulic tightening spanner which has a casing/cylinder unit made as a single piece. This embodiment leads to high production costs, given that the casing is difficult to machine. The ratchet wheel of this invention has toothing with a wide pitch, which creates problems during use when the elastic deformation of the rotating parts of the assembly makes them effect a return motion, or alternatively when the supporting element which is to withstand the reaction loading undergoes such bending that the cylinder of the spanner has to effect too great an off-load travel.

The hydraulic tightening spanners described in DE-A-36 20 753 A1 and DE-A-34 16 881 A1 each exhibit an external casing which serves both as a housing and as something for the hydraulic cylinder to react against. The consequence of this is that the external dimensions of the casing are necessarily large or that the hydraulic service pressures have to be increased substantially. This extremely high service pressure means that protection against cracking has to be provided.

In DE-A-36 20 753 A1, the ratchet wheel exhibits very fine toothing as does the drive element. This type of toothing avoids the drawbacks described hereinabove of the toothing of the spanner of U.S. Pat. No. 4,201,099, but by contrast it has the danger of the small teeth breaking which is inevitably incurred because of the nick effect experienced by such toothing.

Hydraulic tightening spanners are also known which have ratchet wheels in which the notches have rounded flanks and rounded drive elements in the form of cylindrical rods or of a pawl with a rounded end (see EP-A-0276936, EP-A-0179543 and U.S. Pat. No. 4,663,997).

The object of the invention is to eliminate all the disadvantages described hereinabove and to obtain a hydraulically powered tightening spanner which simultaneously resists wear and runs no risk of premature breakage. It is also desirable for the spanner according to the invention to have a relatively low weight and small dimensions, and to allow effective and reliable use while still having a long life even when used to full capacity. It is also necessary for all the elements of the spanner to be guided reliably without any possibility of jamming.

To solve these problems, there has been provided, according to the invention, a spanner as described at the beginning, in which the drive lever fixedly supports a guide and the rotational drive member comprises a slide which supports the drive element or elements and is able to slide along the guide during the reciprocating motion of the piston. This embodiment allows the drive element or elements to accompany the rotational motion of the ratchet wheel better. It allows extremely effective interaction between the drive element or elements of a rounded shape and the rounded flanks of the rounded wheel during the outward stroke of the piston rod. Advantageously, the spanner according to the invention further comprises a compression spring arranged between the drive lever and the slide so as to keep the slide and its drive element or elements pressed between the guide and the ratchet wheel assembly.

According to an improved embodiment of the invention, the drive lever and the slide have mutual engagement means which additionally guide the slide in its motion of sliding relative to the guide. These mutual engagement means in particular limit the axial motion of the slide and prevent it from making any motion other than a sliding motion relative to the guide.

To improve still further the interaction between the ratchet wheel and the drive element or elements throughout the entire duration of the outward stroke of the piston rod, the slide may support a cradle which is mounted in the slide so that it can swing about an axis parallel to the axis of the ratchet wheel assembly and in which the drive element or elements is or are housed. As a preference, the cradle supports at least two drive elements which are parallel and are arranged a distance apart which is equal to a separation between two notches of the ratchet wheel assembly. This latter embodiment makes it possible to distribute the load over several notches of the ratchet wheel simultaneously. As a preference, the drive elements are supported in housings of the drive member from which they partially project, but which they cannot come out of during operation of the spanner.

Other details and specific features of the invention will become clear from the description given hereinafter, without implied limitation and with reference to the attached drawings.

In the various drawings, identical or similar elements bear the same references.

Figure 1:
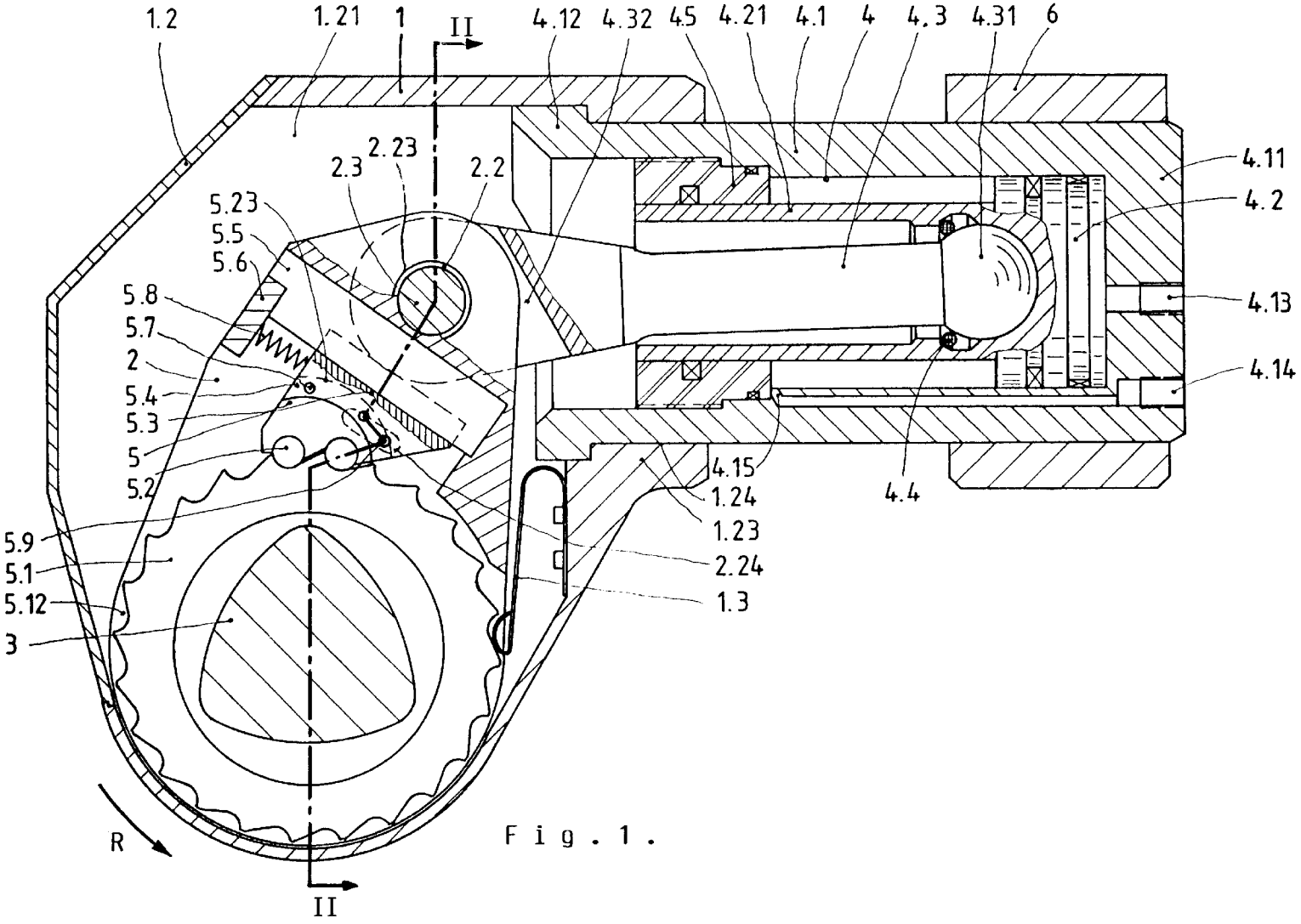
FIG. 1 represents a view in longitudinal section, with partial cutaway, of a hydraulic tightening spanner according to the invention.
Figure 2:
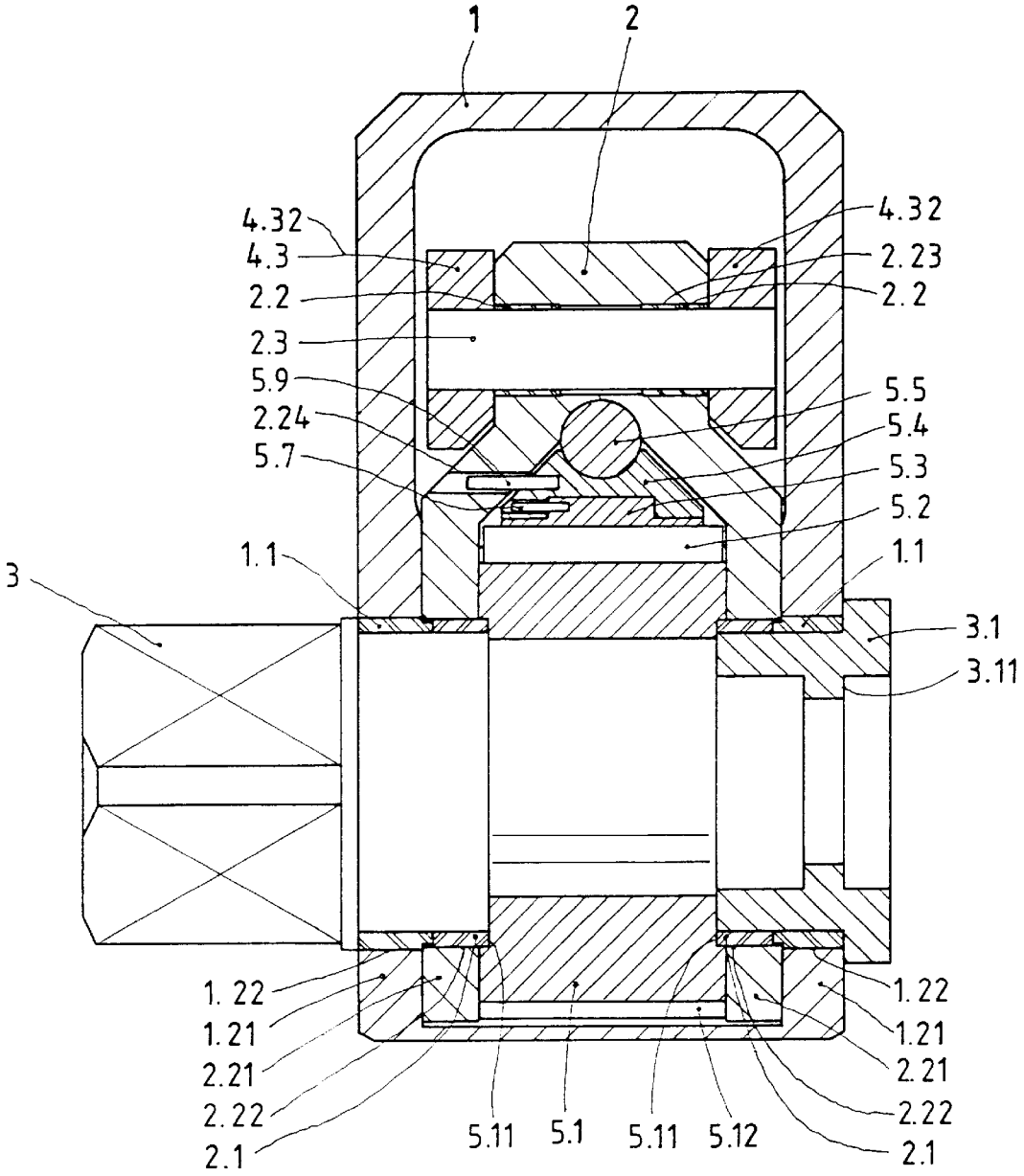
FIG. 2 represents a view in transverse section of this spanner on the line II—II of FIG. 1.

The hydraulic tightening spanner as represented in FIGS. 1 and 2 comprises a casing 1 with two lateral faces 1.21 in which there are bores 1.22 equipped with bushings 1.1 for guiding an adapter 3.

An opening 1.24, through which a hydraulic cylinder 4 may be mounted by press-fitting is provided on the rear face 1.23 of the casing 1.

The front face of the casing 1 is completely open. A drive lever 2 with the built-in ratchet mechanism 5 is inserted into the casing 1 through this opening. After the drive lever has been fitted, the front face of the casing 1 is closed up using a cover 1.2.

The drive lever 2, as represented in FIG. 2, is machined in its front part into the shape of a fork (to the left in FIG. 1) so that a ratchet wheel 5.1 of the ratchet mechanism 5 can be inserted between the lugs 2.21 of the lever.

The lugs 2.21 of the drive lever are provided with coaxial bores 2.22 which are approximately the size of the bores 1.22 in the lateral faces 1.21 of the casing 1.

Bushings 2.1 are mounted in these bores 2.22 after the ratchet wheel 5.1 has been introduced.

The bushings 2.1 are slipped into the lateral chambers 5.11 of the ratchet wheel 5.1 in order to keep it coaxial with the lugs 2.21 of the drive lever 2. At this point, the ratchet wheel 5.1 can turn freely on the rims of the bushings 2.1.

In its upper rear part, the drive lever 2 has a transverse bore 2.23 equipped with bushings 2.2, this bore being parallel to the bores 2.22 and allowing a link which is articulated, by means of the spindle 2.3, with a rod 4.3 of the piston 4.2 of the hydraulic cylinder 4.1. In the embodiment illustrated, the rod 4.3 has the shape of a fork at this end.

Figure 6:
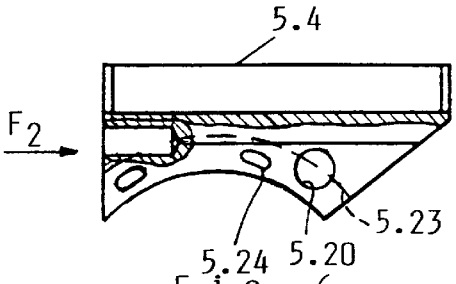
FIG. 6 represents a profile view, with partial cutaway, of the slide employed in the spanner illustrated in FIG. 1.
Figure 7:
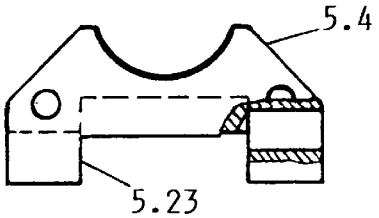
FIG. 7 represents a front-on view, with partial cutaway, of this slide, in the direction F2 of FIG. 6.

Mounted in a bore of the drive lever 2, the axis of which extends in the plane of FIG. 1, between the axes of the bores 2.22 and 2.23 is a guide 5.5 which, in this embodiment, is of cylindrical shape and is fixed axially in position by a stop plate 5.6. Mounted on the guide 5.5 is a member for rotating the ratchet wheel assembly. In this embodiment, this drive member includes a slide 5.4 which is capable of moving in the longitudinal direction of the guide 5.5 (see also FIGS. 6 and 7). In order to prevent the slide 5.4 from being able to lift up excessively relative to the guide 5.5, this slide is guided over a limited distance in oblong holes 2.24 of the drive lever 2 by means of two pins 5.9 fixed on each side of the slide 5.4 in lateral holes 5.20.

In the embodiment illustrated in FIGS. 1 and 2, the drive member further includes a drive cradle 5.3 which is connected to the slide 5.4 by means of pins 5.7 housed in lateral holes 5.21 at the top 5.22 of the cradle. The top of the cradle has an arched shape and it can be housed in a corresponding arched slot 5.23 in the bottom of the slide 5.4. The lateral flanks of this slot 5.23 are equipped with oblong holes 5.24, these too being arched, into which the pins 5.7 penetrate. This configuration allows limited rocking of the drive cradle 5.3 relative to the slide 5.4, this rocking being about an axis parallel to the axis of the ratchet wheel 5.1.

In this embodiment illustrated in FIGS. 1 and 2, the drive member further includes two drive elements in the form of rods, preferably of circular section 5.2, which interact with the notches 5.12 of the ratchet wheel. These rods are mounted in housings 5.25 which are open toward the bottom of the drive cradle 5.3 so that they can slide axially inside. However, the downward opening of the housings 5.25 is smaller than the diameter of the rods 5.2, which allows these to project out of their housing in the direction of the ratchet wheel without being able to come out of this housing. The slide 5.4 and the drive cradle 5.3 are, in the embodiment illustrated, pushed together by at least one pressing spring 5.8 into a rear position so that the slide 5.4 bears against the guide 5.5 and so that the drive elements in the form of cylindrical rods 5.2 mesh with the notches 5.12 of the ratchet wheel 5.1. The latter has notches whose front flanks, in the direction of rotation R of the ratchet wheel, have a profile of rounded shape corresponding to that of the drive elements 5.2 in transverse section. This ensures that the drive elements bear against the front flanks of the notches over a large surface area, and that force is transmitted with all the elements of the drive member being perfectly guided, not only as the ratchet wheel begins to rotate but also throughout practically the entire duration of its advancement by one step. In this way, on optimum connection between the drive lever 2 and the ratchet wheel 5.1 is ensured. Moreover, these notches 5.12 have a progressively sloping rear flank.

A flat spring 1.3 represented in FIG. 1 meshes with a mating shape in one of the notches 5.12 of the ratchet wheel 5.1. The pressing force exerted by the spring 1.3 on the ratchet wheel 5.1 is such that when the drive lever 2 moves forward, the spring 1.3 can slip over the teeth by sliding along the progressive slope of the rear flank of the notch 5.12. As the drive lever 2 returns backward, the pressing force of the spring holds the ratchet wheel 5.1 in position while the drive cradle 5.3 and the slide 5.4 slide over the toothing of the ratchet wheel 5.1, exerting a pressure on the spring 5.8.

In the embodiment illustrated in FIG. 1, the hydraulic actuation cylinder 4 comprises a cylinder 4.1 which has a cylinder end 4.11 integral with it and a frontal shoulder 4.12. At the opposite end of the cylinder from the bottom end 4.11, and directed toward the inside of the casing, the cylinder is provided with a guide bushing 4.5. An extension piece of reduced section 4.21 of a piston 4.2 which is capable of sliding inside the cylinder passes through this bushing. This piston 4.2 is connected in an articulated manner to one end of a piston rod 4.3 with a spherically-shaped head 4.31. At its other end this piston rod forms a fork 4.32 in which bores are provided allowing passage for the spindle 2.3 which serves to provide the articulated link between the piston rod 4.3 and the drive lever 2.

The spherical head 4.31 of the piston rod 4.3 is housed in a spherical cavity of the piston. It is held there in an axial fashion by a ring 4.4 made of an elastic material which is inserted between the spherical head 4.31 and an internal rib of the extension piece 4.21 of the piston 4.2. This configuration thus allows the piston rod 4.3 to rock about its spherical head during the straight movement of the piston 4.2 itself.

A first supply duct 4.13 emerges in a rear chamber of the cylinder 4, in front of one of the front faces of the piston, and it conveys a pressurized fluid for allowing the outward, so-called working stroke. A second supply duct 4.14 is pierced on the side through the wall of the cylinder parallel to the bore of the cylinder and it emerges via a connecting duct 4.15 in a front chamber of the cylinder. This duct takes the pressurized fluid for the return stroke of the piston. The piston 4.2 is guided by its extension piece of rigid section 4.21 in the guide bushing 4.5 during its outward and return strokes.

When the pressurized fluid is conveyed through the first supply duct 4.13, the piston 4.2 moves toward the casing 1 and causes the drive lever 2 to pivot to the left in FIG. 1 about the axis of the ratchet wheel. At this moment, the cylindrical drive elements 5.2 of the drive cradle 5.3 mesh with the circular-arc-shaped notches 5.12 of the ratchet wheel 5.1.

The drive cradle 5.3 can position itself in a swinging fashion in the circular-arc-shaped slot 5.23 of the slide 5.4 in such a way that the cylindrical rods 5.2 of the drive cradle 5.3 fit perfectly into the front flanks of the notches of the ratchet wheel 5.1.

The slide 5.4 and the drive cradle 5.3 are held pressed between the guide 5.5 and the ratchet wheel 5.1 by the spring 5.8 so that the ratchet wheel 5.1 is driven in the direction R while the drive lever 2 pivots to the left (see FIG. 1). During this time, the rear flanks of the teeth of the ratchet wheel 5.1 slide under the spring 1.3.

During this forward motion, the ratchet wheel is blocked resting against the drive member driven by the actuating lever. As a consequence, it transmits this rotational motion to the adapter 3, or directly to an element to be screwed or unscrewed. The adapter may be embodied in any appropriate way. Advantageously, it may have a profile known as a "polygon" as illustrated in FIG. 1. The adapter is placed over the head of a fastener, for example a hexagon nut, and it turns the latter through the angle of pivoting of the drive lever. The adapter 3 may be inserted into the casing 1 from each side. It is held axially in this casing on the opposite side by an intermediate ring 3.1 with bayonet fastening 3.11.

For the return motion of the piston 4.2, the pressurized fluid is conveyed by the second feed duct 4.14 while the pressurized fluid lying inside the rear chamber of the cylinder can return freely (without pressure) to the reservoir of the hydraulic unit through the duct 4.13. At this moment, the drive lever 2 is returned toward its initial position to the right (see FIG. 1). During this time, the ratchet wheel 5.1 is held in position by means of the spring 1.3 to prevent it from rotating backward.

The drive cradle 5.3 and the slide 5.4 are returned toward the rear and the pressure of the spring 5.8 allows the cylindrical rods 5.2 of the drive cradle 5.3 to slide to the right (see FIG. 1) over the rear flanks of the teeth of the ratchet wheel 5.1.

When loosening nuts which have been firmly tightened or which are very corroded, it sometimes happens that these come loose abruptly, rotating quite violently and suddenly backward after a certain loosening torque has been applied to them. At this moment, the quite high inertia forces are transmitted into the various components of the hydraulic tightening spanner, and they may cause it to be destroyed or damaged.

If, for example, a nut comes loose abruptly, the driving lever 2 will want to follow this abrupt motion. The piston rod 4.3 and the piston 4.2, which are connected to the lever 2, cannot follow this abrupt motion because of the moments of inertia and they may thus, if circumstances are not in their favor, be damaged or destroyed.

In order to prevent this type of drawback, the ring 4.4 made of an elastic material makes it possible to absorb and deaden impacts which are due to the phenomena described hereinabove.

The element 6 for reacting against (see FIG. 1) is in fact an element of annular shape with a lateral offset not represented.

The interior contour of the reaction arm 6 has the same shape as the external contour of the actuating cylinder 4. It is slipped over the cylinder 4 and may be locked in several positions thereon in the longitudinal sense by means of pins. In order to do this, the cylinder is provided on its wall with semicircular slots into which the pins may be locked.

This reaction arm 6 allows the hydraulic spanner to absorb the reaction torque. This has to be applied against a sufficiently strong support. Such as, for example, a screw head nearby or the outer side of a flange [sic].

In the embodiment according to FIG. 1, the hydraulic actuating cylinder is mounted inside the casing on the transverse axis and is pressed to an appropriate opening in the latter until it comes into abutment against a shoulder 4.12 made for this purpose.

Figure 8:
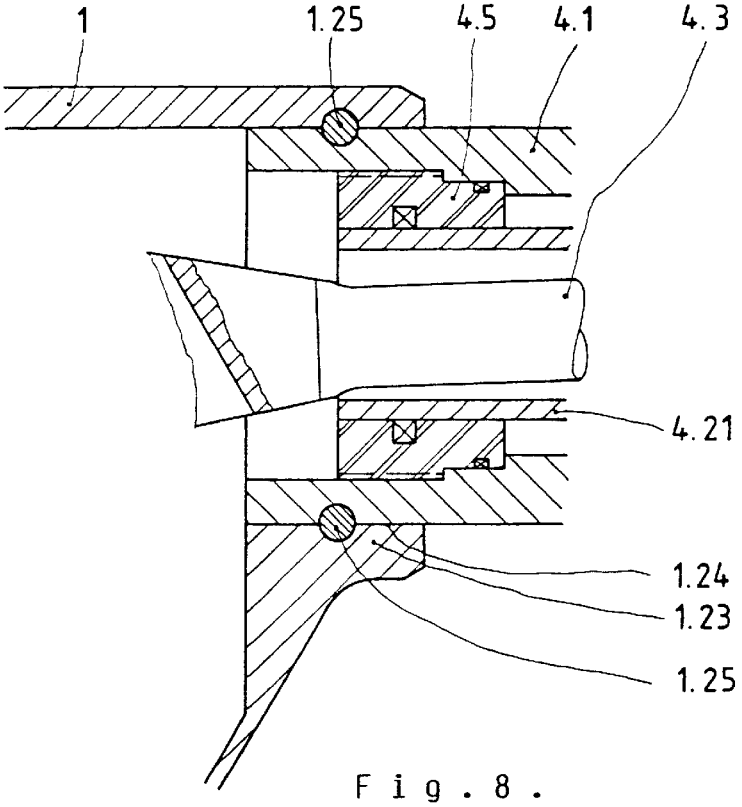
FIG. 8 represents a sectional view of an assembly detail of an alternative form according to the invention.

In an alternative form (see FIG. 8), the shoulder is replaced by one or more pins 1.25 situated mid-way along the surface for contact between the hydraulic cylinder 4.1 and the opening in the casing.

This method of fastening is an additional safety feature preventing the hydraulic cylinder from sliding inside the casing.

Figure 3:
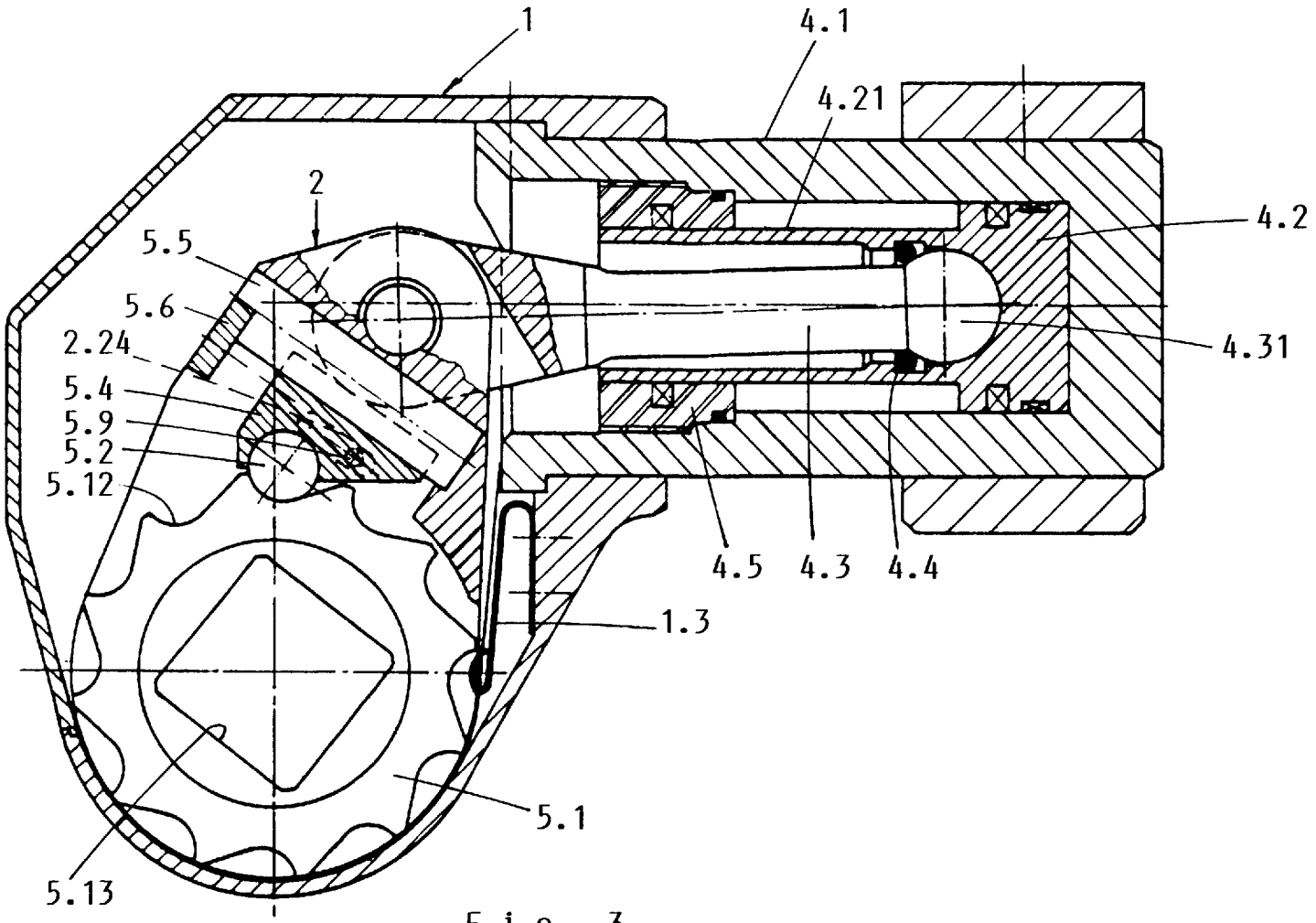
FIG. 3 represents a view in longitudinal section of another spanner embodiment according to the invention.
Figure 4:
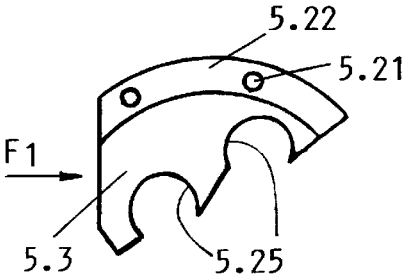
FIG. 4 represents a profile view of the cradle employed in the spanner illustrated in FIG. 1.
Figure 5:
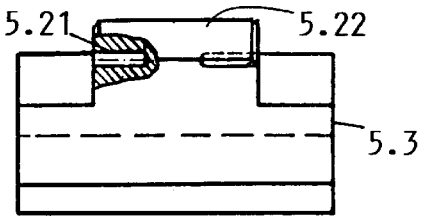
FIG. 5 represents a front-on view, with partial cutaway, of this cradle in the direction of the arrow F1 of FIG. 4.

Another spanner embodiment according to the invention is illustrated in FIG. 3. This spanner is distinguished from the spanner according to FIGS. 1 and 2 by the fact that it has just one drive rod 5.2 with circular section. Given this fact, a rocking motion of the rod 5.2 relative to the slide proves less necessary than in the embodiment according to FIGS. 1 and 2. This explains the absence of the drive cradle and the housing of the drive rod 5.2 directly in the slide 5.4.

In this embodiment, the ratchet wheel itself has a central bore 5.13 in the shape of a square.

It must be understood that the present invention is not in any way limited to the embodiments described hereinabove and that many modifications can be made thereto without departing from its scope.

For example, a greater number of drive elements 5.2, for example three or more may be envisaged. The section thereof could have a curvature other than that of a circle, so long as the notches have a front flank with corresponding curvature.

Retaining mechanisms other than the flat spring 1.3 may also be conceived.

Central bores of the ratchet wheel with hexagonal or some other shape are also conceivable.

What is claimed is:

1. A hydraulically powered tightening and loosening spanner comprising a casing, a hydraulic operating cylinder which is housed in the casing and in which a piston equipped with a piston rod may be moved with a reciprocating motion, a drive lever connected to the piston rod in an articulated manner, a ratchet wheel assembly which is mounted in the casing so that it can rotate about an axis, is capable of being fitted over an element to be tightened or to be loosened, and is provided at its periphery with notches, having flanks which, in profile, have an at least a partially rounded shape, a drive member for rotating the ratchet wheel assembly supported by the drive lever and including at least one drive element interacting with the said rounded flanks of the said notches of the ratchet wheel assembly to make it turn in a first direction of rotation during an outward stroke of the reciprocating motion of the piston, and a retaining mechanism which interacts with the ratchet wheel assembly and prevents it from turning in a second direction which is opposite to the first direction during a return stroke of the reciprocating motion of the piston, the drive lever fixedly supporting a guide and a rotational drive member further comprising a slide which supports the at least one drive element and is able to slide along the guide during the reciprocating motion of the piston, wherein the slide supports a cradle which is mounted in the slide to swing about an axis parallel to the axis of the ratchet wheel assembly and in which the at least one drive element is housed.

2. A hydraulically powered tightening and loosening spanner comprising a casing, a hydraulic operating cylinder which is housed in the casing and in which a piston equipped with a piston rod may be moved with a reciprocating motion, a drive lever connected to the piston rod in an articulated manner, a ratchet wheel assembly which is mounted in the casing so that it can rotate about an axis, is capable of being fitted over an element to be tightened or to be loosened, and is provided at its periphery with notches, having flanks which, in profile, have an at least a partially rounded shape, a drive member for rotating the ratchet wheel assembly supported by the drive lever and including at least one drive element interacting with the said rounded flanks of the said notches of the ratchet wheel assembly to make it turn in a first direction of rotation during an outward stroke of the reciprocating motion of the piston, and a retaining mechanism which interacts with the ratchet wheel assembly and prevents it from turning in a second direction which is opposite to the first direction during a return stroke of the reciprocating motion of the piston, the drive lever fixedly supporting a guide and a rotational drive member further comprising a slide which supports the at least one drive element and is able to slide along the guide during the reciprocating motion of the piston, wherein said drive member includes a cradle which supports at least two drive elements which are parallel and are arranged a distance apart which is equal to a separation between two notches of the ratchet wheel assembly.

* * * * *